United States Patent [19]

Phelps

[11] Patent Number: 4,737,270

[45] Date of Patent: Apr. 12, 1988

[54] METHOD AND APPARATUS FOR SEPARATING "POPS" FROM PECANS

[76] Inventor: William D. Phelps, #1 Diana, Little Rock, Ark. 72205

[21] Appl. No.: 872,836

[22] Filed: Jun. 11, 1986

[51] Int. Cl.[4] ..... B07B 11/04

[52] U.S. Cl. ..... 209/138; 209/154; 209/643

[58] Field of Search ..... 209/643, 138, 139.1, 209/142, 143, 154, 146; 426/231

[56] References Cited

U.S. PATENT DOCUMENTS

| | | | |
|---|---|---|---|
| 1,491,211 | 4/1924 | Taylor | 209/269 |
| 2,220,320 | 11/1940 | Dragon | 209/138 |
| 2,870,002 | 1/1959 | Johnson | 209/138 X |
| 3,265,210 | 8/1966 | Harte et al. | 209/143 X |
| 3,611,688 | 10/1971 | Phelps et al. | 56/328 R |
| 3,669,264 | 6/1972 | Bryant | 209/138 |
| 3,779,377 | 12/1973 | Phelps | 209/138 |
| 4,219,410 | 8/1980 | Herder | 209/143 |
| 4,453,703 | 6/1984 | Ivanov et al. | 209/154 X |
| 4,465,194 | 8/1984 | Coleman | 209/138 X |
| 4,475,562 | 10/1984 | Thatcher et al. | 209/138 X |
| 4,490,247 | 12/1984 | Forsberg et al. | 209/143 X |
| 4,515,686 | 5/1985 | Janich | 209/154 X |

FOREIGN PATENT DOCUMENTS

| | | | |
|---|---|---|---|
| 544154 | 6/1957 | Canada | 209/643 |

*Primary Examiner*—Robert B. Reeves
*Assistant Examiner*—Donald T. Hajec
*Attorney, Agent, or Firm*—Franklin D. Wolffe; Morris Fidelman

[57] ABSTRACT

In separating pecan meats according to weight, removal of acceptable pecans along with lighter, unacceptable pecans is obviated by avoiding the increased vacuum on acceptable pecans which occurs when an unacceptable pecan restricts a vacuum duct used for such separation. In one embodiment, positive and negative fluid pressures are utilized in concert to avoid such a restriction.

3 Claims, 2 Drawing Sheets

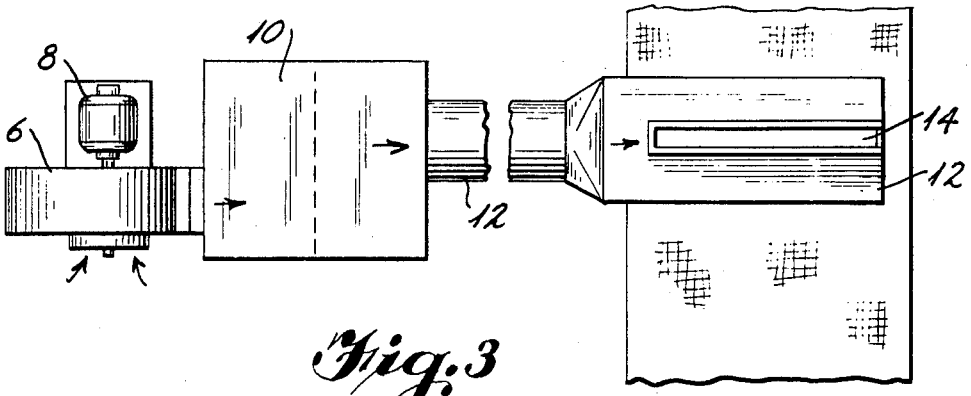
Fig. 3
Fig. 4
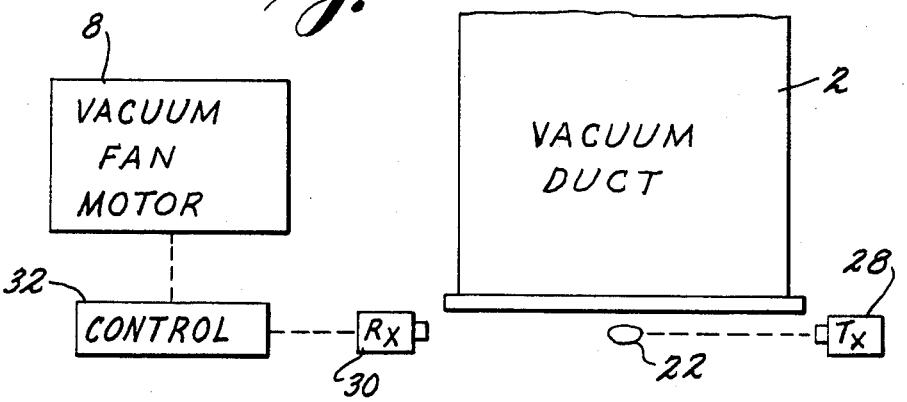

METHOD AND APPARATUS FOR SEPARATING "POPS" FROM PECANS

CROSS REFERENCE TO THE PRIOR ART

U.S. Pat. No. 1,491,211 to Taylor—DISTRIBUTING AND CLEANING DEVICE FOR FRUIT AND THE LIKE, issued Apr. 22, 1924.

U.S. Pat. No. 2,220,320 to Dragon—APPARATUS FOR SHELLING NUTS, issued Nov. 5, 1940.

U.S. Pat. No. 3,611,688 to Phelps and Phelps—NUT HARVESTING MACHINE, issued Oct. 12, 1971.

U.S. Pat. No. 3,779,377 to Phelps—PECAN CLEANER, issued Dec. 18, 1973.

BACKGROUND AND OBJECTS OF THE INVENTION

The invention deals with separation of objects according to weight and, more particularly, to an improved method and apparatus for separating defective light weight pecans, hereinafter sometimes referred to as "pops," from heavier good pecans.

Typically, "pops" will be either shriveled-up or normal in appearance and hollow on the inside, and attempts have been made to remove such lighter, defective pecans from the heavier, good pecans by conveying them under an air vacuum nozzle and suctioning the lighter pecans from a foraminous or meshed conveyor. A problem experienced with these attempts, at various negative pressures which are sufficient for vacuuming at least one "pop" from the good pecans, is that a defective pecan restricts the suction nozzle, resulting in an increase in the suction felt by the remaining pecans on the conveyor and the removal of good, heavier pecans therefrom by this increased suction. In order to remove an acceptable amount of the "pops" by the prior art devices, a costly loss of good, heavier pecans is also experienced.

It is an object of this invention to provide a method and apparatus for separating objects, particularly pecans, according to weight by extracting the lighter objects from the heavier objects by vacuum while preventing the heavier objects from experiencing a vacuum increase which is sufficient to extract them along wih the lighter objects, wherein such an increased vacuum on the heavier objects is caused by restriction of a vacuum nozzle or duct.

It is a further object of the invention to limit the vacuum applied to the objects to be separated to a level which, in itself, is insufficient to draw-up the objects to a position of restriction of the vacuum nozzle, while providing a positive pressure to the other side of the objects which is sufficient to move the "lights" away from the "heavies", and wherein any unrestricting of the pressure nozzle outlet by removal of an object therefrom will result in reduced pressure on the remaining objects situated in front of the outlet nozzle.

Additionally, it is an object of the instant invention to regulate the negative pressure applied to an object by raising or lowering the suction nozzle in response to a restriction of the nozzle by any of the objects.

BRIEF SUMMARY OF THE INVENTION

In one embodiment of the invention, negative and positive fluid pressures are simultaneously applied to opposite sides of objects traveling through a separation station with the negative pressure felt by the objects being insufficient, in itself, of drawing any of the objects to a suction nozzle and the positive pressure being such as to move the light objects away from the heavy objects just sufficiently to be drawn to the vacuum nozzle by the negative pressure.

BRIEF DESCRIPTION OF THE DRAWINGS

FIG. 3 is a partial top plane view of FIG. 1.

FIG. 4 is a block diagram schematically illustrating control of the negative pressure in response to restriction of a nozzle by an object.

DETAILED DESCRIPTION OF THE INVENTION

Figure 1:
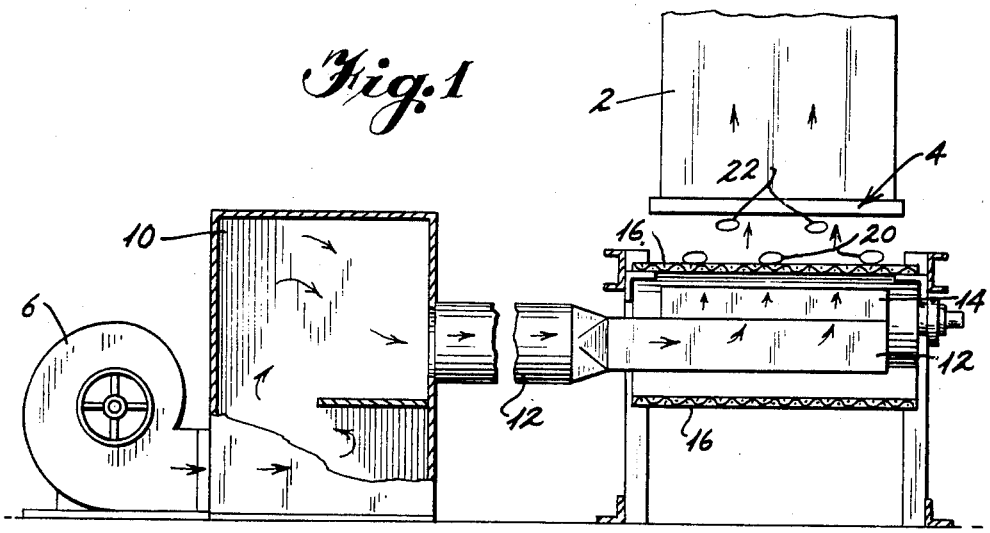
FIG. 1 is an elevational view, partially in crossection, illustrating one embodiment of the invention which is utilized to separate pecans according to weight.
Figure 2:
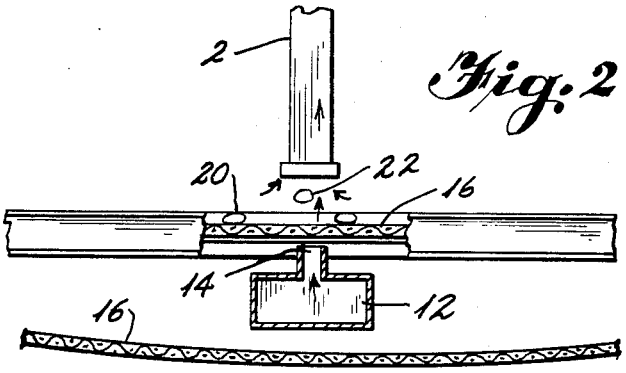
FIG. 2 is a partial right side view of FIG. 1.

One embodiment of the invention is illustrated in FIGS. 1–3, wherein a conventional vacuum duct 2 is positioned above a wire mesh conveyor belt for removal of light pecans such as "pops" and shriveled pecans 22 from heavier, acceptable pecans 20 as the pecans are conveyed underneath vacuum nozzle 4. These FIGS. 1–3 also illustrate the improvement to the above-described prior art, namely, the provision of positive fluid pressure from pressure nozzle 14 which is situated on the opposite side of the conveyor belt 16 from that of vacuum nozzle 2. Fluid pressure is supplied to outlet nozzle 14 via ducting 12, pressure plemum 10, and fan 6.

This embodiment overcomes the problems experienced when only a vacuum has been used, namely, the restriction of the vacuum nozzle by a light pecan causing an increased vacuum to be felt by the remaining pecans which resulted in a number of acceptable, heavier pecans 20 being extracted by the vacuum duct 2 along with each light pecan 22. In this improvement over the prior art, the negative pressure in duct 2 and/or spacing of nozzle 4 from conveyor belt 16 is adjusted such that the negative pressure, in and of itself, is insufficient to evacuate the light pecans 22 or, for that matter, to raise the light pecans 22 to a position of restricting the nozzle 4 sufficiently to evacuate any good pecans 20 at the separation station. The positive pressure from nozzle 14 is then adjusted to raise the light pecans 22 sufficiently above the remaining pecans 20 as to augment the suction from nozzle 4 and allow evacuation of the light pecans 22. Thus, acceptable pecans 20 are not evacuated by increased vacuum caused by such a restriction.

FIG. 4 illustrates another embodiment of the invention in which the negative pressure applied to suction nozzle 4 is regulated in response to restriction of the nozzle by light pecans 22. A photo detection means comprises a transmitter 28 and a receiver 30 such that interruption of the beam therebetween by an object causes the vacuum fan motor 8 to be reduced via control 32 so that the negative pressure in duct 2 is lowered during restriction thereof. Appropriate timing may be provided for beginning to reduce the negative pressure as soon as pecan 22 begins to restrict nozzle 4 and for allowing a set amount of time for evacuation of the pecan through the ducting 2 before again increasing the negative pressure therein, as by varying the speed of motor 8.

Although only one transmitter 28 and receiver 30 is illustrated in FIG. 4 as providing a beam across the long portion of nozzle 4, it is also contemplated that a plurality of cooperating transmitters and receivers may be positioned to provide light beams perpendicular to the direction of the beam illustrated in FIG. 4 so that the occurence of more than one light pecan 22 entering nozzle 4 simultaneously may be detected.

Having described the invention, it will be seen that the objects set forth above, among those made apparent from the preceding description, are efficiently obtained and, since certain changes may be made in carrying out the above method and in the construction set forth without departing from the scope of the invention, it is intended that all matter contained in the above description or shown in the accompanying drawings shall be interpreted as illustrative and not in a limiting sense. For instance, although the invention has been practiced with the positive pressure being supplied by a fan separate from the source of negative pressure, it is contemplated herein that both of the negative and positive fluid pressures could be provided by the same fan.

It is also to be understood that the following claims are intended to cover all of the generic and specific features of the invention herein described, and all statements of the scope of the invention, which as a matter of language, might be said to fall therebetween.

I claim:

1. An apparatus for separating heavier and lighter objects according to weight, comprising:

conveyor means for moving heavier and lighter objects to be separated along a path of travel;

a separation station disposed along the path of travel, comprising:

negative pressure means above the path of travel for applying a negative pressure to the objects moved along the path of travel;

positive pressure means located beneath the path of travel and directly opposite said negative pressure means for applying positive pressure to the objects simultaneously with the negative pressure to lift the lighter objects from the conveyor means;

means for controlling at least one of the positive and negative pressures on the objects such that the lighter objects are moved sufficiently away from the heavier objects to effect removal of substantially only the lighter objects from the conveyor means, said means for controlling comprising means for reducing the negative pressure of the negative pressure means upon restriction of the negative pressure means by an object being moved;

whereby the negative pressure applied to the objects by the negative pressure means is at a level insufficient by itself of removing objects from the conveyor means.

2. A method for separating heavier and lighter objects according to weight, comprising:

moving the objects to be separated on a conveyor means along a path of travel;

applying a negative pressure to the objects from a negative pressure means disposed above the path of travel;

simultaneously applying positive pressure to the object from a positive pressure means disposed beneath the path of travel and directly opposite said negative pressure means;

limiting the negative pressure applied to the objects to a level insufficient by itself of removing objects from the conveyor means; and controlling the negative pressure on the objects such that the lighter objects are moved sufficiently away from the heavier objects to effect removal of substantially only the lighter objects from the path of travel, the controlling step comprising reducing the negative pressure of the negative pressure means upon restriction of the negative pressure means by an object being removed.

3. The method of claim 2, wherein the objects to be separated are pecans.

* * * * *